US005181862A

United States Patent [19]

Hawk et al.

[11] Patent Number: 5,181,862

[45] Date of Patent: Jan. 26, 1993

[54] DIAGNOSTIC HEADER ASSEMBLY

[75] Inventors: Gary W. Hawk, Halifax; Earl J. Hayes, Mechanicsburg; Alexander Hunt, III, Harrisburg, all of Pa.; Bobby G. Ward, King, N.C.

[73] Assignee: AMP Incorporated, Harrisburg, Pa.

[21] Appl. No.: 737,003

[22] Filed: Jul. 29, 1991

[51] Int. Cl.[5] ..... H01R 13/40

[52] U.S. Cl. ..... 439/595; 439/598; 439/752

[58] Field of Search ..... 439/595, 598, 752

[56] References Cited

U.S. PATENT DOCUMENTS 4,557,542 12/1985 Coller et al. ..... 339/59 M
4,565,416 1/1986 Rudy et al. ..... 339/59 M
4,583,805 4/1986 Mantlik ..... 339/61 R
4,820,198 4/1989 Lulko et al. ..... 439/595
4,891,021 1/1990 Hayes et al. ..... 439/599
4,934,959 6/1990 Zielinski et al. ..... 439/598
5,044,991 9/1991 Colleran et al. ..... 439/595

*Primary Examiner*—Paula A. Bradley
*Attorney, Agent, or Firm*—Alan B. Osborne; Bruce J. Wolstoncroft

[57] ABSTRACT

An electrical header assembly (10) for use in automobiles is disclosed. The assembly (10) includes a housing (12) with terminal-receiving cavities (26) recessed in from a front face (62), terminals (18), a separate one piece latch (14) received in the housing (12) to retain the terminals (18) in the cavities (26) and a separate terminal position assurance member (16).

7 Claims, 5 Drawing Sheets

DIAGNOSTIC HEADER ASSEMBLY

FIELD OF THE INVENTION

The present invention relates to a header assembly for use in automobiles.

BACKGROUND OF THE INVENTION

In at least one state, California, state law requires that beginning in 1994, all automobiles must have a common interface or header into which a connector receptacle can be plugged into for the purpose of checking the emissions from the engine. Accordingly, it is now proposed to provide a header for use in automobiles which meets specifications established for the common interface.

SUMMARY OF THE INVENTION

According to the present invention, an electrical headed assembly is provided which includes a housing having two rows of cavities with a slot between the cavities and orifices connecting the slot and respective cavities, terminals and a separate, one piece latch having spring arms positioned in the slot with the spring arms extending into the cavities through the orifices to retain the terminals therein.

DESCRIPTION OF THE INVENTION

Figure 1:
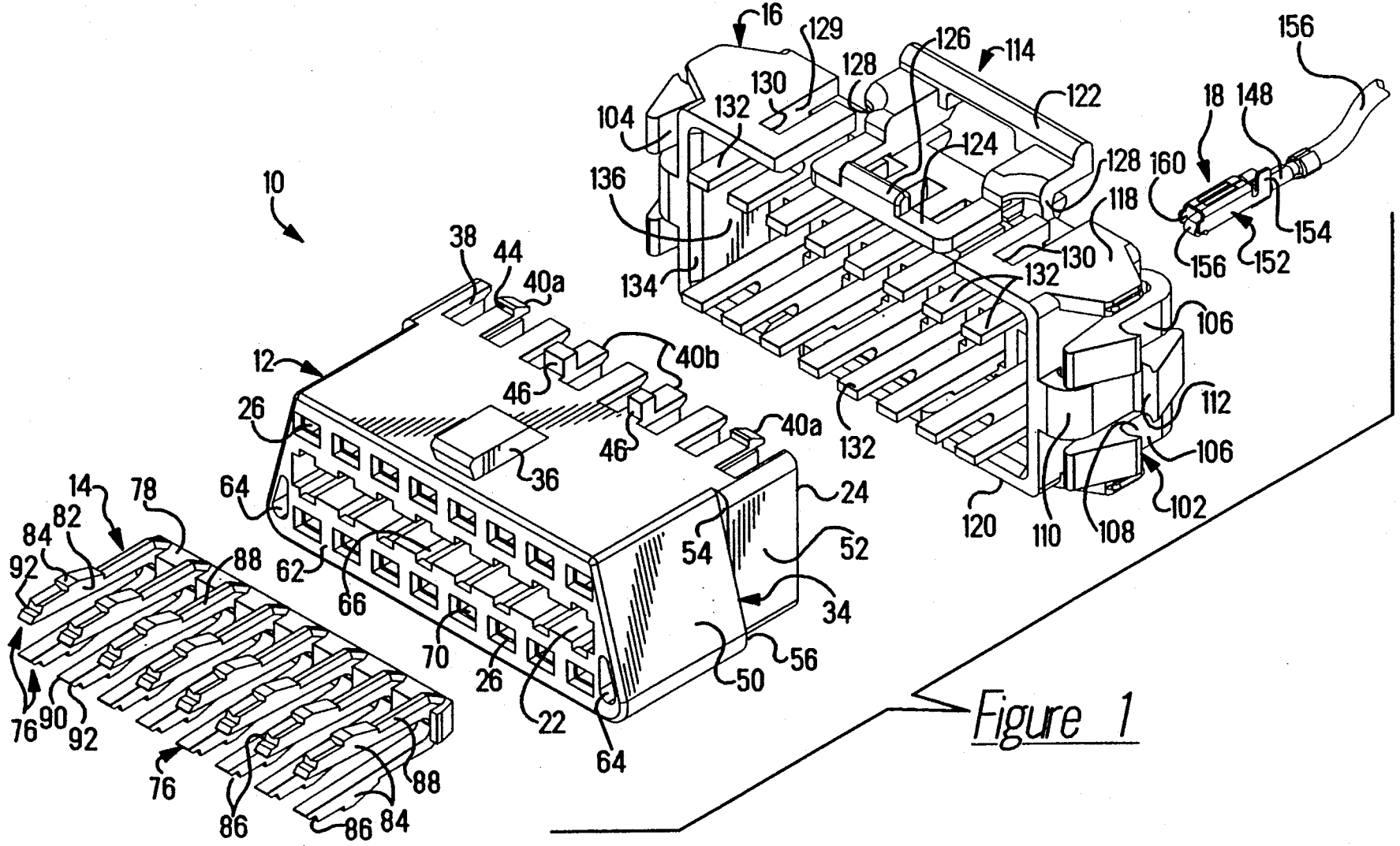
FIG. 1 is an exploded view of a header assembly constructed in accordance to one embodiment of the present invention.

With reference to FIG. 1, header assembly 10 includes housing 12, terminal latch 14, terminal position assurance (TPA) member 16 and terminal 18.

Figure 8:
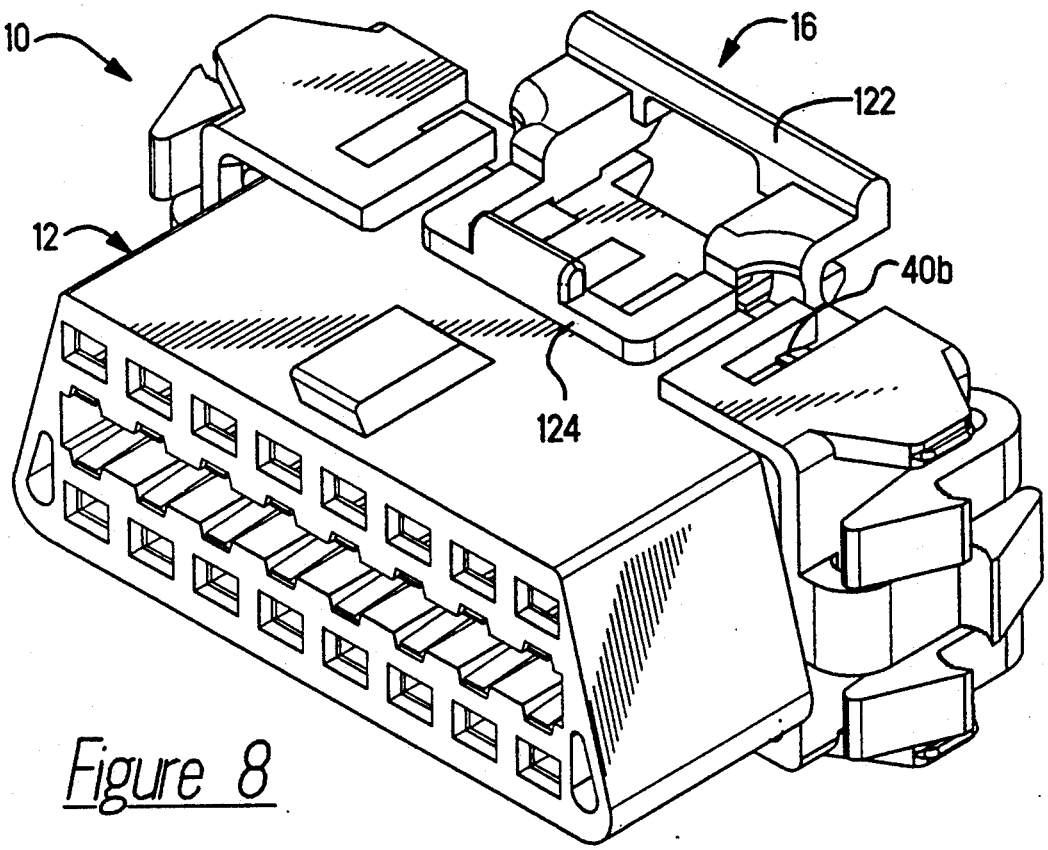
FIG. 8 is an exterior view of the assembly of FIG. 7.

Generally speaking, terminal latch 14 is inserted into slot 22 of housing 12 and TPA member 16 is assembled to housing 12 on its rear face 24 to a first position. Terminals 18 are inserted into terminal cavities 26 in housing 12 through member 16 and retained by latch 14. Thereafter, TPA member 16 is pushed and locked into a final position to form assembly 10 as shown in FIG. 8.

Housing 12 may be molded from a suitable plastics material such as PBT.

Its exterior configuration includes parallel surfaces 30,32 and complex side surfaces 34. With respect to surface 30, a orientation latch block 36 is located centrally thereon. Rear portion 38 is slotted in registration with cavities 26 to define fingers 40. Fingers 40-*a* are resilient and have forwardly facing latch shoulders 44. Non-resilient fingers 40-*b* are provided with latch posts 46. Rear portion 38 of surface 32 (not shown) also include fingers 40 with latch shoulders 44 and latch posts 46 on fingers 40-*a* and 40-*b* respectively.

Side surfaces 34 include front portions 50 which slant inwardly to surface 30 from surface 32 and parallel rear portions 52. The juncture of portions 50,52 provide forwardly facing shoulders 54 near surface 30 and rearwardly facing shoulders 56 near opposite surface 32.

The aforementioned slot 22 enter housing 12 through front face 62 as do openings 64 which are adjacent surface 32.

The walls (168-*a*, FIG. 3) defining slot 22 are provided with orifice 66 which are in alignment and communicate with respective cavities 26. Openings 70 lead to cavities 26 through face 62.

The interior configuration and rear face 24 of housing 12 is described below.

Figure 3:
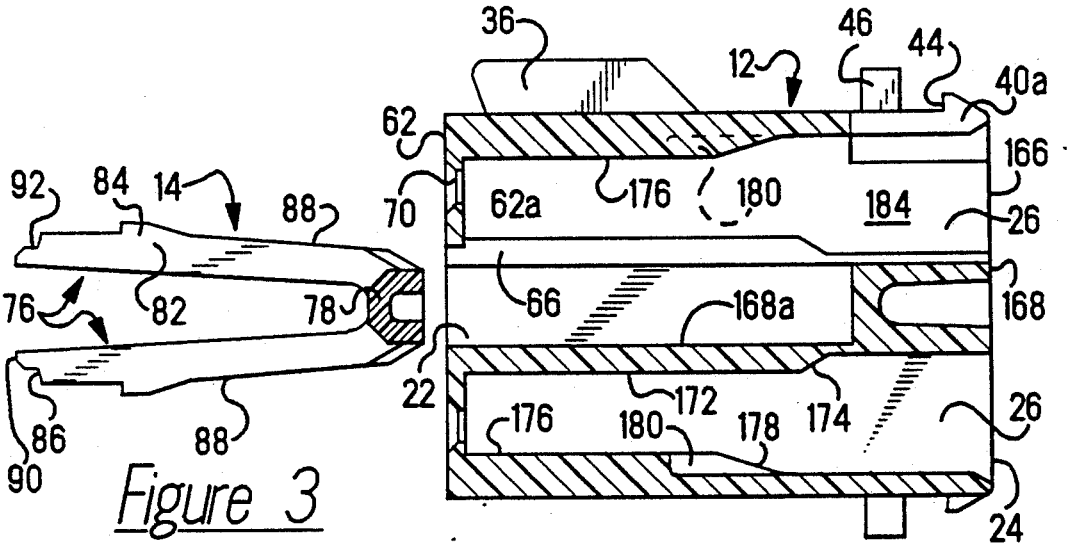
FIG. 3 shows a side sectional view of the housing and a side view of the terminal latch of the assembly.

Terminal latch 14 may also be molded from PBT. As shown in FIG. 3 also, latch 14 includes two rows of spring arms 76 extending outwardly from support 78. Each row of arms 76 are positioned to enter respective orifices 66 in slot 22 and enter respective terminal cavities 26 as will be shown further on in this disclosure. Each arm 76 has a thicker portion 82 outwardly from support 78 which is stepped down to provide a boss 84 and forwardly facing shoulder 86, both being on outside edge 88. Shoulder 86 is just inwardly from free end 90 to define notches 92.

With reference to FIG. 1, TPA member 16 includes panel locks 102 on side surfaces 104. Locks 102 have two spaced-apart, forwardly projecting spring arms 106 with rearwardly facing shoulder 108 and one rearwardly projecting spring arm 110 between arms 106 and carrying a forwardly facing shoulder 112. Edges of a panel opening (not shown) are received between respective shoulders 108 and 112 to secure assembly 10 in the opening.

Pivoting latches 114 are provided in recesses 116 (see FIG. 2) on surfaces 118,120 and include squeeze bars 122 and latch bars 124. The latch bar 124 on the latch 114 on surface 118 carries an outwardly projecting boss 126. The pivot points on latches 114 are indicated by reference numeral 128. Slots 129 in surfaces 118,120 provide rearwardly facing shoulders 130.

Two rows of resilient fingers 132 extend outwardly through front opening 134 from within cavity 136 of TPA member 16. Fingers 132 are on the same pattern as are terminal cavities 26 and are in registration therewith as will be shown and described further on.

Figure 2:
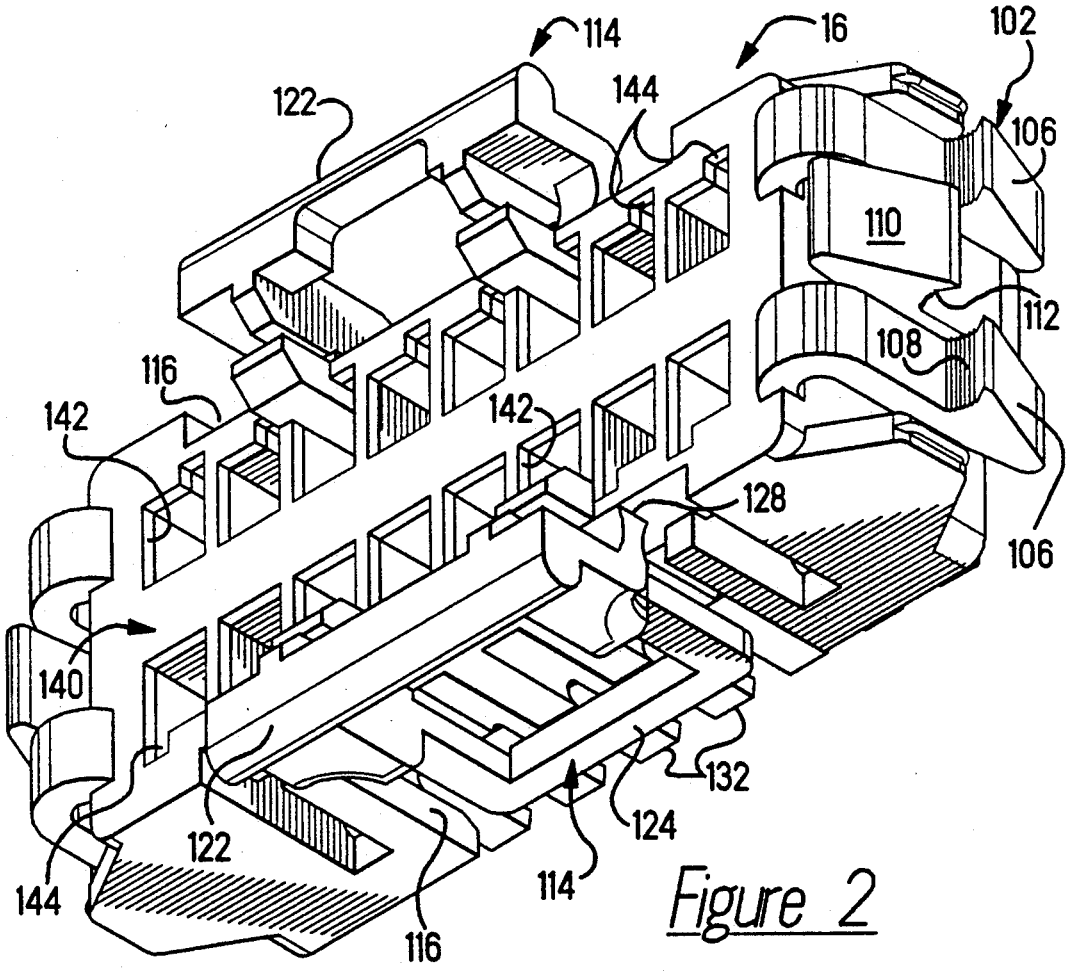
FIG. 2 shows a reverse face of the terminal position assurance (TPA) member of the assembly.

Rear face 140 of member 16, shown in FIG. 2, is provided with openings 142 into cavity 136. Each opening 142 includes polarizing slot 144 at one corner.

Figure 5:
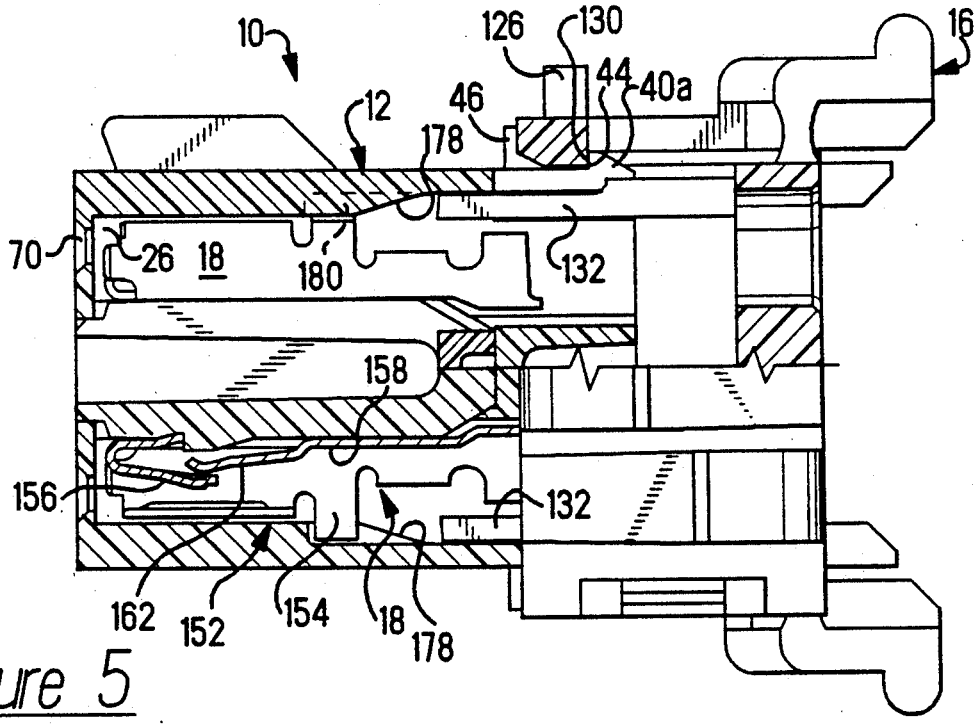
FIG. 5 shows a side section view of the assembly with the TPA member in a first position.

Terminal 18, as shown in FIG. 1, includes a ferrule 148 crimped around wire 150 and a rectangular receptacle 152. At the rear end and on one side of receptacle 152 a polarizing stub 154 projects outwardly. Biasing first spring arm 156, attached to floor 158 (FIG. 5) of receptacle 152, is folded to project into the receptacle through opening 160. Spring arm 156 and the interior of receptacle 152 is shown in FIG. 5 to which the reader's attention is now directed. It can be seen that a second spring arm 162, blanked out from floor 158 underlies and supports first spring arm 156. The blanking out of spring arm 156 provides opening 164 in floor 158.

Terminal 18 is preferably stamped and formed from tempered brass and tin-plated.

Reference is now made to FIG. 3 which shows the interior of housing 12. Cavities 26 are open at rear face 24 as indicated by reference numeral 166. The two rows of cavities 26 are separated by a longitudinal shelf 168 which has been hollowed out at its front end to define slot 22. Orifices 66 extend through the two walls, 168-*a*, defined by slot 22 into respective cavities 26. Surface 172 of cavities 26 include ramp 174 to decrease the thickness of the front portion. Opposite surface 176 also include a ramp 178 and a slit 180 extending into the thicker wall portion. The aforementioned openings 70 through front face 62 are beveled inwardly to guide tab terminals (not shown). An important advantage is that cavities 26 are inwardly from front face 62 so that, as shown in FIG. 5, terminals 18 are fully protected.

FIG. 3 also shows the removal of the cavity side walls 184 below fingers **40-*a*** to provide resiliency so that they can be pushed down as will be explained later on.

Figure 4:
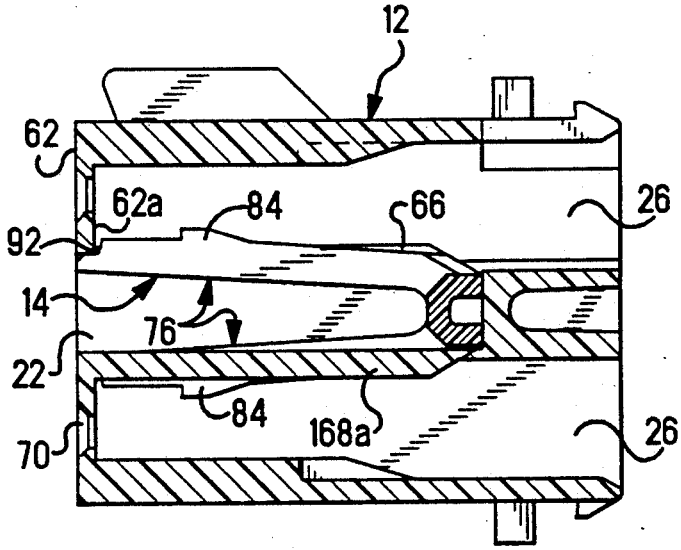
FIG. 4 shows the latch inserted in the housing.

FIG. 4 shows terminal latch 14 inserted into slot 22 in housing 12 with support 78 abutting the end wall of the slot. Spring arms 76 have moved through orifices 66 so that bosses 84 are in cavities 26. Latch 14 is retained in housing 12 by notches 92 engaging the interior surface **62-*a* of face 62**.

FIG. 5 shows assembly 10 with terminals 18 loaded into cavities 26 and TPA member 16 in a first position on housing 12. Wires 150 have been omitted for purposes of clarity. In loading, terminals 18 must be orientated so that polarizing stub 154 enters slot 144 in opening 142 (FIG. 2) and into slit 180 in cavity surface 176. As receptacles 152 enter into cavities 26, spring fingers 76 are deflected and then spring back as bosses 84 thereon enter openings 164 in floor 158 of receptacles 152. Terminals 18 cannot be backed out without moving arms 76 out of the way.

TPA member 16 is added to housing 12 to a first position and is latched there by shoulder 44 on resilient finger **40-*a* catching on shoulder 130. The only way member 16 can be removed is by depressing all four fingers 40-*a*** simultaneously.

Fingers 132 on member 16 are in cavities 26 just back of ramps 178.

Figure 6:
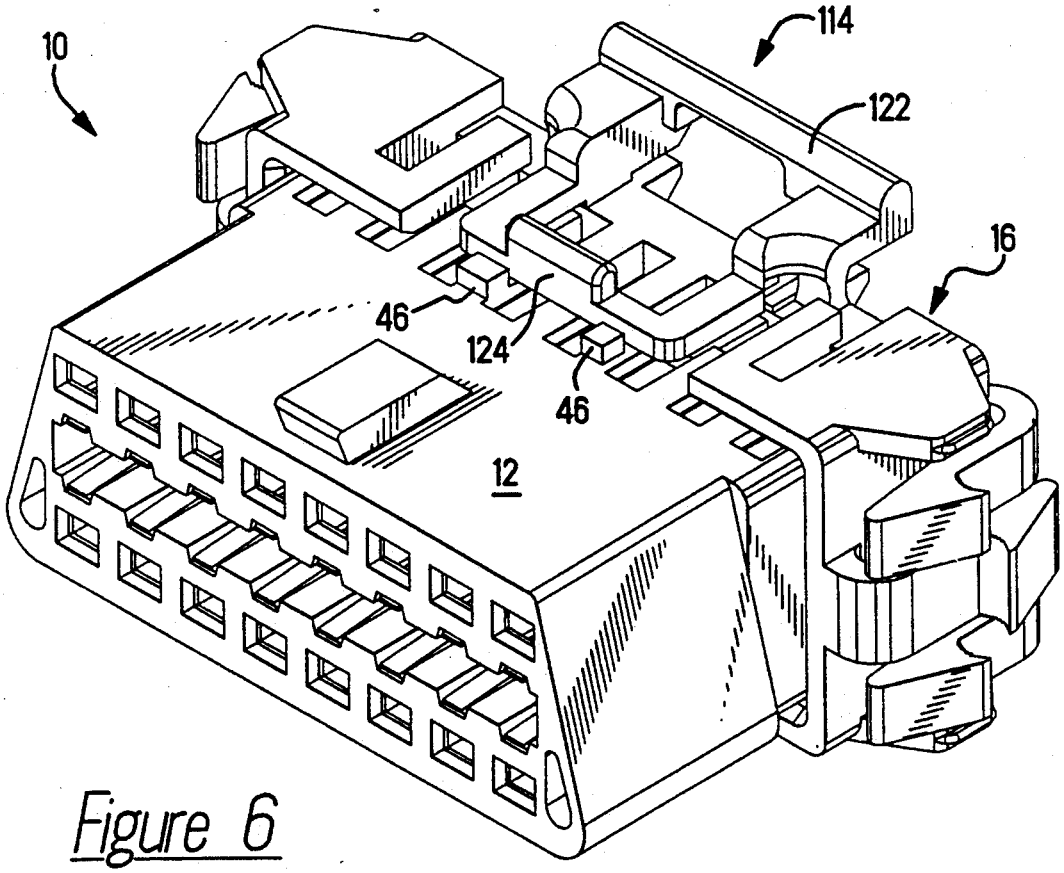
FIG. 6 is an exterior view of the assembly of FIG. 5.

FIG. 6 is another view of assembly 10 showing TPA member 16 at the first position. This view shows that member 16 cannot be further moved onto housing 12; i.e. posts 46 are blocking latch bars 124 on latches 114, without squeezing squeeze bars 122 together to lift latch bars 124 over posts 46.

Figure 7:
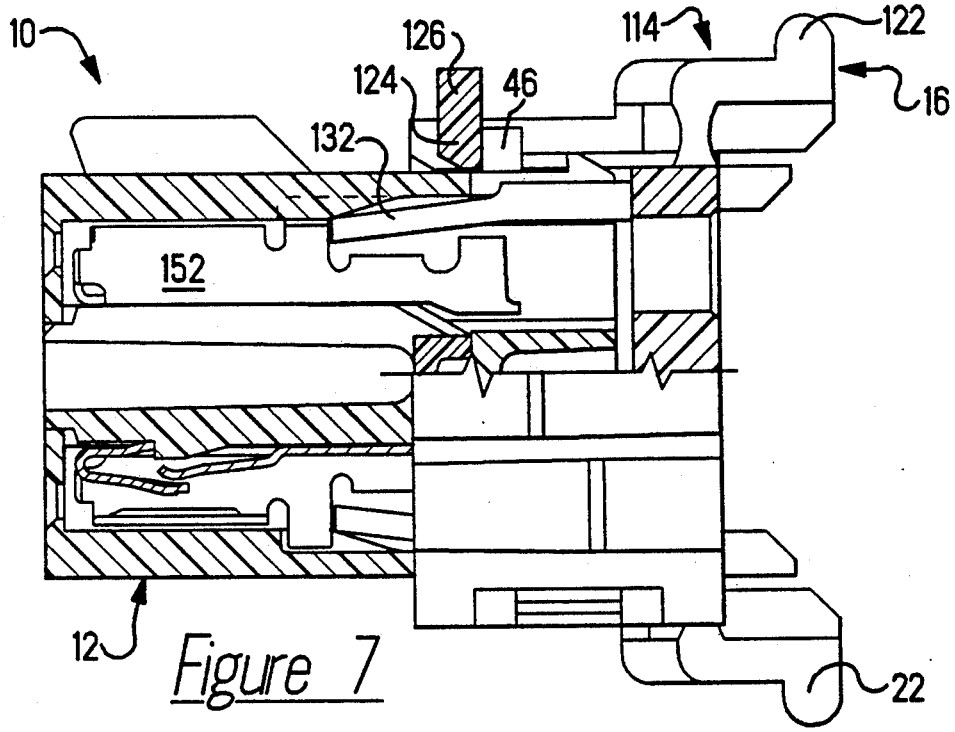
FIG. 7 is a side section view of the assembly with the TPA member in a final position.

FIGS. 7 and 8 show TPA member 16 in the second and final position on housing 12. Fingers 132 have been cammed down ramps 178 to a position abutting the rear end of receptacle 152 on terminals 18. The ability of fingers 132 to be moved fully in against receptacles 152 signal the operator that all terminals 18 have been properly treated. Obviously, fingers 132 will push terminals 18 into place or if a resistance is met, then one or more terminals 18 are not properly in respective cavities 26.

Member 16 is moved into the final position assurance location by squeezing squeeze bars 122 towards each other to lift latch bars 124 over and on the other side of posts 46 as shown in FIG. 8. Thus member 16 cannot be moved back without lifting bars 124 up over posts 46.

As can be discerned from the foregoing description, a header assembly has been disclosed. The assembly includes a housing, a separate terminal latch, terminals and a terminal position assurance (TPA) member. The advantages of the present invention include a TPA member which is pre-assembled to a first position on the housing and cannot be removed without special tools and cannot be moved to a second, final position without a positive action by the operator. The separate internally located terminal latch is protected from damage and obviates the need for the terminals themselves having latching lances. The terminal dual spring arms provide low insertion force with maximum normal force to achieve good electrical connection with mating tab terminals. Further, the housing and terminals have polarizing structures to prevent incorrect assembly and placement in automobiles.

In addition to the advantages noted above, a very important one is that front face 62 protects terminal spring arm 156 from damage by a mating tab blade.

We claim:

1. An electrical connector comprising:

a housing having a rear face and an oppositely facing front face, side surfaces extend from the front face to the rear face;

a plurality of terminal receiving cavities provided in the housing, the terminal receiving cavities extend from proximate the front surface to proximate the rear surface;

a plurality of terminals positioned in the terminal receiving cavities;

a latch receiving slot which extends from the front face toward the rear face, the slot positioned proximate to the terminal receiving cavities;

a separate latch member positioned in the latch receiving slot, the latch member has a plurality of resilient latch arms provided thereon, the latch arms have free ends which are positioned proximate the front face of the housing, and fixed ends which are positioned away from the front surface toward the rear surface, the fixed ends are attached to a support portion, the free ends have bosses provided thereon, the bosses extend into the terminal receiving cavities to latch the terminals in respective terminal receiving cavities.

2. An electrical connector comprising:

a housing having a rear face and an oppositely facing front face, side surfaces extend from the front face to the rear face;

a plurality of terminal receiving cavities provided in the housing, the terminal receiving cavities extend from proximate the front surface to proximate the rear surface;

a plurality of terminal positioned in the terminal receiving cavities;

a latch receiving slot which extends from the front face toward the fear face, the slot positioned proximate to the terminal receiving cavities;

a separate latch member positioned in the latch receiving slot, the latch member has a plurality of resilient latch arms provided thereon, the bosses extend into the terminal receiving cavities to latch the terminals in respective terminal receiving cavities, the resilient latch arms having thicker portions which extend from an integral support portion, the thicker portions are stepped down to provide the bosses.

3. An electrical connector as recited in claim 3 wherein shoulders are provided proximate free ends of the resilient latch arms, the shoulders cooperate with the housing to maintain the latch member in the slot.

4. An electrical connector as recited in claim 2 wherein the support portion of the latch member abuts an end wall of the slot.

5. An electrical connector comprising:

a housing having a rear face and an oppositely facing front face;

a plurality of terminal receiving cavities provided in the housing, the terminal receiving cavities extend from proximate the front surfaces to proximate the rear surface;

a plurality of terminals positioned in the terminal receiving cavities;

a latch receiving slot which extends from the front face toward the rear face, the slot positioned proximate to the terminal receiving cavities, a separate latch member positioned in the latch receiving slot, the latch member has a support member with a plurality of resilient latch arms which extend therefrom, the resilient latch arms extend into the terminal receiving cavities to latch the terminals in respective terminal receiving cavities, the latch arms have free ends which are positioned proximate the front face of the housing, and fixed ends which are positioned away from the front surface toward the rear surface, the fixed ends are attached to the support member.

6. An electrical connector comprising:

a housing having a rear face and an oppositely facing front face;

a plurality of terminal receiving cavities provided in the housing, the terminal receiving cavities extend from proximate the front surface to proximate the rear surface;

a plurality of terminals positioned in the terminal receiving cavities;

a latch receiving slot which extends from the front face toward the rear face, the slot positioned proximate to the terminal receiving cavities;

a separate latch member positioned in the latch receiving slot, the latch member has a support member with a plurality of resilient latch arms which extend therefrom, the resilient latch arms extend into the terminal receiving cavities to latch the terminals in respective terminal receiving cavities, the support member of the latch member abuts an end wall of the slot.

7. An electrical connector comprising:

a housing having a rear face and an oppositely facing front face;

a plurality of terminal receiving cavities provided in the housing, the terminal receiving cavities extend from proximate the front surface to proximate the rear surface;

a plurality of terminals positioned in the terminal receiving cavities;

a latch receiving slot which extends from the front face toward the rear face, the slot positioned proximate to the terminal receiving cavities;

a separate latch member positioned in the altch receiving slot, the latch member has a support member with a plurality of resilient latch arms which extend therefrom, the resilient latch arms extend into the terminal receiving cavities to latch the terminals in respective terminal receiving cavities, the resilient latch arms have thicker portions which extend from the support portion, the thicker portions are stepped down to provide bosses, shoulders are provided proximate free ends of the resilient latch arms, the shoulders cooperate with the housing to maintain the latch member in the slot.

* * * * *

UNITED STATES PATENT AND TRADEMARK OFFICE

CERTIFICATE OF CORRECTION

PATENT NO. : 5,181,862

DATED : January 26, 1993

INVENTOR(S) : Gary Wilbert Hawk et al.

It is certified that error appears in the above-identified patent and that said Letters Patent is hereby corrected as shown below:

In claim 2, column 4, line 47, change "fear" to --rear--.

Signed and Sealed this

Thirtieth Day of November, 1993

Bruce Lehman

*Attest:*

BRUCE LEHMAN

*Attesting Officer*

*Commissioner of Patents and Trademarks*